US007697258B2

(12) United States Patent
Vernitskiy et al.

(10) Patent No.: US 7,697,258 B2
(45) Date of Patent: Apr. 13, 2010

(54) AIR ASSIST FOR AC IONIZERS

(75) Inventors: Grigoriy N. Vernitskiy, San Francisco, CA (US); Peter Gefter, South San Francisco, CA (US); Lawrence Levit, Alamo, CA (US)

(73) Assignee: MKS Instruments, Inc., Andover, MA (US)

( * ) Notice: Subject to any disclaimer, the term of this patent is extended or adjusted under 35 U.S.C. 154(b) by 585 days.

(21) Appl. No.: 11/539,610

(22) Filed: Oct. 6, 2006

(65) Prior Publication Data

US 2007/0158578 A1 Jul. 12, 2007

Related U.S. Application Data

(60) Provisional application No. 60/726,874, filed on Oct. 13, 2005, provisional application No. 60/778,755, filed on Mar. 3, 2006.

(51) Int. Cl.
*H01T 23/00* (2006.01)
*H05F 3/04* (2006.01)

(52) U.S. Cl. ..... 361/230; 361/213

(58) Field of Classification Search ..... 361/220, 361/213, 230

See application file for complete search history.

(56) References Cited

U.S. PATENT DOCUMENTS 3,411,025 A * 11/1968 Marks ..... 310/11
3,624,448 A 11/1971 Saurenman et al
3,650,092 A * 3/1972 Gourdine et al. ..... 96/40
4,713,257 A 12/1987 Luttermoller
4,751,759 A * 6/1988 Zoell ..... 15/1.51
6,506,232 B2 1/2003 Menear
6,653,638 B2 * 11/2003 Fujii ..... 250/423 R
6,807,044 B1 10/2004 Vernitsky et al.
6,941,606 B2 * 9/2005 Mariani et al. ..... 15/1.51

FOREIGN PATENT DOCUMENTS

GB 2068606 * 8/1983

OTHER PUBLICATIONS

Blaine R. Copenheaver, International Search Report for PCT International Application PCTUS06/60195, Apr. 23, 2008, pp. 1-2, ISA/US, Alexandria, VA, US.

Blaine R. Copenheaver, Written Opinion for PCT International Application PCTUS06/60195, Apr. 23, 2008, cover sheet, Box No. I, V, VII and four sheets of Supplemental Boxes, ISA/US, Alexandria, VA, US.

* cited by examiner

*Primary Examiner*—Stephen W Jackson
*Assistant Examiner*—Zeev Kitov
(74) *Attorney, Agent, or Firm*—Stephen R. Uriarte

(57) ABSTRACT

At least one orifice is added to an AC ionizer with nozzles and ionizing electrodes that are used to remove static charge. The orifice is placed in a location where electrostatic forces are weak and where gas ions can be easily extracted from the ionizer. Ionizer effectiveness is enhanced by recovering gas ions that are normally trapped between the nozzles and under a portion of the ionizer from which the nozzles project. Without the orifice properly positioned, the trapped gas ions are lost by recombination or grounding. With the orifice positioned in an area of weak electrostatic forces, more gas ions are available for discharging the charged object. The combined air consumption of nozzles plus at least one orifice is the same or less than nozzles alone would consume for a given discharge time.

44 Claims, 8 Drawing Sheets

28

AIR ASSIST FOR AC IONIZERS

CROSS-REFERENCE TO RELATED APPLICATIONS

This application claims the benefit of U.S. provisional application 60/726,874 filed Oct. 13, 2005 and entitled "Orifice Assist for Ionizers with Airflow Nozzles", and U.S. provisional application 60/778,755, filed Mar. 3, 2006 and entitled "Fringe Field Ion Extraction for Ionization Systems".

BACKGROUND OF THE INVENTION

1. Field of the Invention

The present invention relates to an alternating current (AC) ionizer that removes or minimizes static charge from a charged object selected for static charge removal. More particularly, the present invention relates to an AC ionizer that uses at least one flowing gas to enhance the static neutralization of the charged object.

2. Description of Related Art

It is generally known that AC ionizers, sometimes referred to as "AC static neutralizers", remove static charge by ionizing gas molecules, and delivering these ionized gas molecules, named gas ions, to a charged object. These gas ions are typically created by applying a high voltage to ionizing electrodes, by releasing nuclear sub-atomic particles, or by ionizing photon radiation. The location in which these gas ions are created is referred to as an ionizing source. Positive gas ions neutralize negative static charges, and negative gas ions neutralize positive static charges.

Delivering gas ions to a charged object is a factor in the static charge removal effectiveness of an AC ionizer because only the gas ions that reach the charged object produce useful charge removal, hereinafter "useful gas ions". Static charge removal is also sometimes referred to as "static charge neutralization". There are at least two mechanisms responsible for gas ion loss: recombination and grounding. Both recombination and grounding losses are more probable when gas ions are held to the ionizer by strong electrostatic forces.

One approach for reducing the effects of recombination and grounding includes using at least one nozzle with flowing air or gas with an AC ionizer, such as described in U.S. Pat. No. 6,807,044. Recombination is minimized because the flowing gas exiting a nozzle dilutes the gas ions before the positive ions and negative ions are mixed. Upon mixing, the lower gas ion density results in a lower recombination rate. In addition, the flowing gas from the nozzle propels the gas ions toward a charged object targeted for neutralization, which reduces the transport time and conserves the ions. Additionally, a nozzle can be oriented to direct generated gas ions toward the charged object, reducing the number of gas ions lost from grounding. Finally, some air nozzle geometries protect the ionizing electrodes from impurities in the environment.

For example, one type of AC ionizer places an ionizing electrode inside a nozzle. High purity air, nitrogen, or other non-reactive gas flows through each nozzle and along the ionizing electrode. This combination of nozzle and flowing gas partially protects the ionizing electrode from impurities in the environment, which reduces the cleaning frequency of ionizing electrodes, reducing the cost of maintenance and ownership. Moreover, ion balance is maximized because less buildup occurs on the ionizing electrode tips.

Although combining nozzles with an AC ionizer enhances the neutralization efficiency of the AC ionizer, nozzles alone miss the opportunity for even better AC ionizer performance.

Consequently, a need exists for enhancing the performance of an AC static neutralizer that employs at least one nozzle.

DETAILED DESCRIPTION OF THE INVENTION

Figure 1:
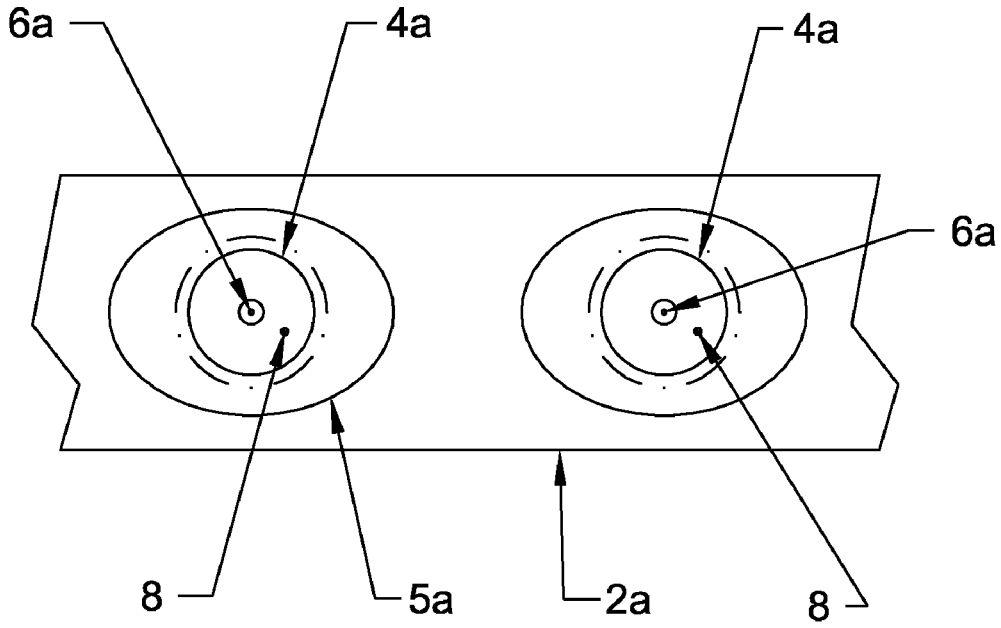
FIG. 1 is a bottom view of a portion of an AC ionizer that utilizes nozzles.

While the invention has been described in conjunction with a specific best mode, it is to be understood that many alternatives, modifications and variations will be apparent to those skilled in the art in light of the following description. The use of these alternatives, modifications and variations in or with the various embodiments of the invention shown below would not require undue experimentation or further invention.

The various embodiments of the present invention described herein are generally directed to the improvement of AC ionizers that utilize nozzles by adding at least one orifice within a placement zone between adjacent ionizing electrodes. Although AC ionizers that utilize nozzles are known, such as the AC ionizer disclosed in U.S. Pat. No. 6,807,044, hereinafter the "Patent" and which is incorporated by reference as if fully set forth herein, it is not intended that the various embodiments of the present invention be limited to existing AC ionizer designs.

Although a gas is delivered through both nozzles and orifices, nozzles and orifices are different. The term "nozzle" includes a structure with a hollow inner portion. One example is a cylinder having an inner and outer diameter. An ionizing electrode is positioned within that hollow inner portion. Gas flows through that hollow inner portion, and past the ionizing electrode. The term "orifice" includes an opening through which air or gas may exit. An air orifice does not possess or contain an ionizing electrode.

The term "placement zone" is defined as the optimal location or area for placing at least one orifice between adjacent nozzles that are disposed on an AC ionizer and that each have an ionizing electrode contained generally within their inner portion. This placement zone area is not an additional hardware structure. It is a geometrical projection onto the face or surface of a portion of an AC ionizer that contains nozzles. In accordance with one embodiment of the present invention, the placement zone has a shape in cross-section that is commonly referred to as a diamond shape.

AC ionizers differ from DC ionizers. With an AC ionizer, typically all ionizing electrodes are connected to the same voltage source. Unlike DC ionizers, the strongest attractive electrostatic field forces for AC ionizers are found between the ionizing electrodes and ground. And, unlike DC ionizers, electrostatic field forces between adjacent ionizing electrodes are repulsive. Gas ions produced by one ionizing electrode are repelled by an adjacent ionizing electrode because they have the same polarity. As a consequence, the optimal placement of orifices is different for an AC ionizer than it is for a DC ionizer, and gas ion delivery efficiency for AC ionizers can be improved by adding at least one orifice between adjacent nozzles that each contains an ionizing electrode.

For an AC ionizer, the placement zone between adjacent nozzles is particularly useful for two reasons. First, gas ions that would normally be lost to grounding are present in the placement zone in moderately high concentration. Recovery of these gas ions is functionally equivalent to creating more gas ions. Second, gas ions in the placement zone are not held tightly to the AC ionizer by strong electrostatic fields.

In addition, AC ionizer discharge times commonly achieved by using nozzles alone can be reduced by placing at least one orifice between adjacent ionizing electrodes within a placement zone. It has been further observed that this decrease in discharge times is achieved even when the total gas consumption from the nozzles and the orifice(s) does not exceed the consumption from the nozzles alone.

Figure 2:
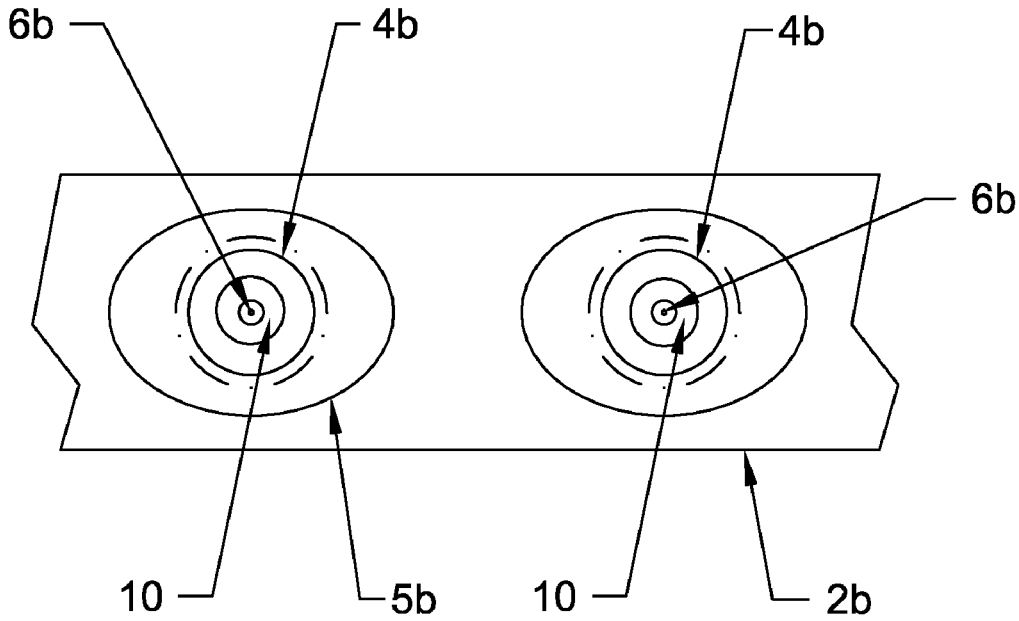
FIG. 2 is a bottom view of another portion of an AC ionizer that utilizes nozzles.

Referring now to the drawings, FIGS. 1 and 2 depict examples of AC ionizer portions 2*a* and 2*b* that use nozzles 4*a* and 4*b* and ionizing electrodes 6*a* and 6*b*, respectively. Gas ions are created by corona discharge when a high voltage is applied to ionizing electrodes 6*a* and 6*b*. In FIG. 1, gas enters nozzle 4*a* from a pressurized supply (not shown) through a jet 8 located besides ionizing electrode 6*a*, while in FIG. 2, gas enters nozzle 4*b* through a concentric opening 10. After exiting jet 8 or concentric opening 10, the gas flows around and past ionizing electrodes 6*a* or 6*b*, respectively.

The term "gas" is intended to include a gas or a combination of gases, such as air. This gas is supplied to nozzles 4*a* and 4*b* through tubing or through a common plenum, which is not shown to avoid overcomplicating FIGS. 1 and 2.

Utilizing nozzles help protect ionizing electrodes from impurities since relatively pure or clean gas may be forced to flow past and generally along the ionizing electrode. Impurities from air within the operating environment of the ionizer are thus largely excluded from contacting the ionizing electrodes, minimizing particle buildup on the ionizing electrodes. Moreover, balance and discharge time remain constant for long time periods, and the frequency of cleaning is reduced.

Nozzles, such as nozzles 4*a* and 4*b*, also direct gas ions toward a charged object (not shown), reducing the gas ion density required for neutralizing the charged object. Also, the ion movement transit time to the object is reduced by the gas nozzle flow, which decreases ion recombination.

Figure 3:
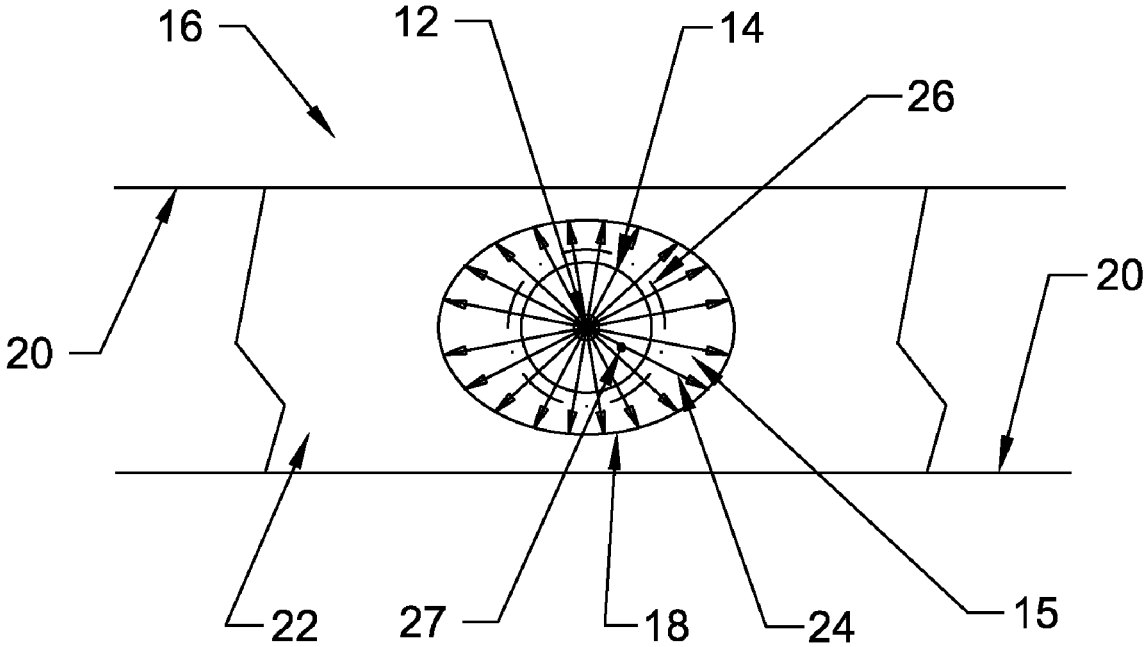
FIG. 3 is a bottom view diagram of electrostatic field lines between an ionizing electrode and nearby non-ionizing electrode having a circular edge and a reference potential, such as ground.

FIG. 3 illustrates a configuration of an ionizing electrode 12 within a nozzle 14 from an AC ionizer portion 16. Nozzle 14 receives gas from a plenum 15 and is disposed through a cut-out 18 formed on a bottom surface 20. Plenum 15 provides a supply of pressurized gas or gases, such as air, to nozzle 14. Bottom surface 20 includes a conductive surface 22 that receives a reference potential, such as ground. When used in this manner, conductive surface 22 may be referred to as a non-ionizing electrode or as a reference electrode.

When conductive surface 22 is used as a reference electrode and when a sufficient voltage from a high voltage power supply (not shown) is applied to ionizing electrode 12, electrostatic field lines 24 originating at ionizing electrode 12 are grounded at the edge of the cut-out 18. Because electrostatic field lines 24 are strong in a region 26, gas exiting from jet 27 and flowing out of nozzle 14 is marginally effective for harvesting or displacing gas ions (not shown) created within region 26. Most of these gas ions will follow electrostatic field lines 24 to conductive surface 22, grounding gas ions that would have been useful for static charge neutralization, reducing the efficiency of the AC ionizer.

Figure 4:
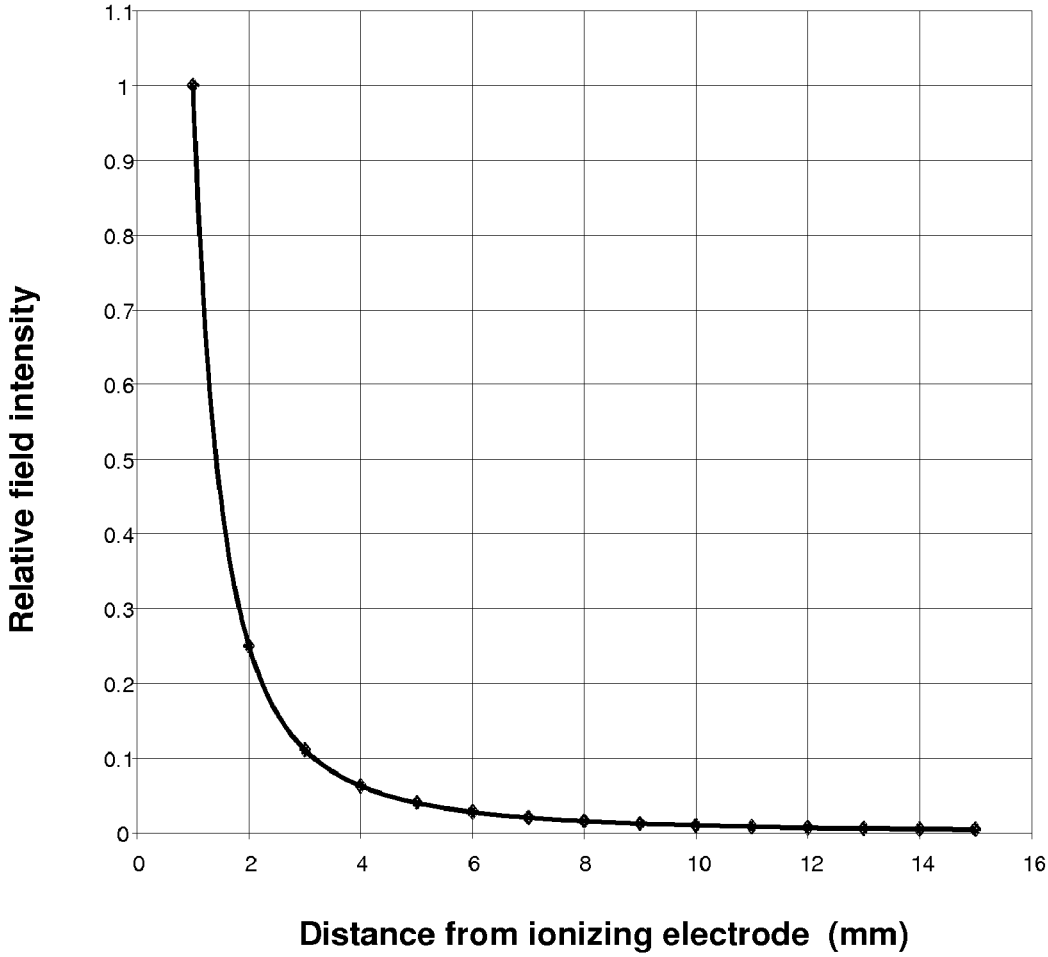
FIG. 4 shows a graph which illustrates the relationship between electrostatic field force on gas ions and the distance from the source of the electrostatic field.

FIG. 4 includes a graph 28 that illustrates the relationship between the strength of electrostatic field forces and the distance from the source of the electrostatic field. Graph 28 shows that electrostatic field forces on gas ions increase as the distance from an ionizing electrode decreases.

Figure 5:
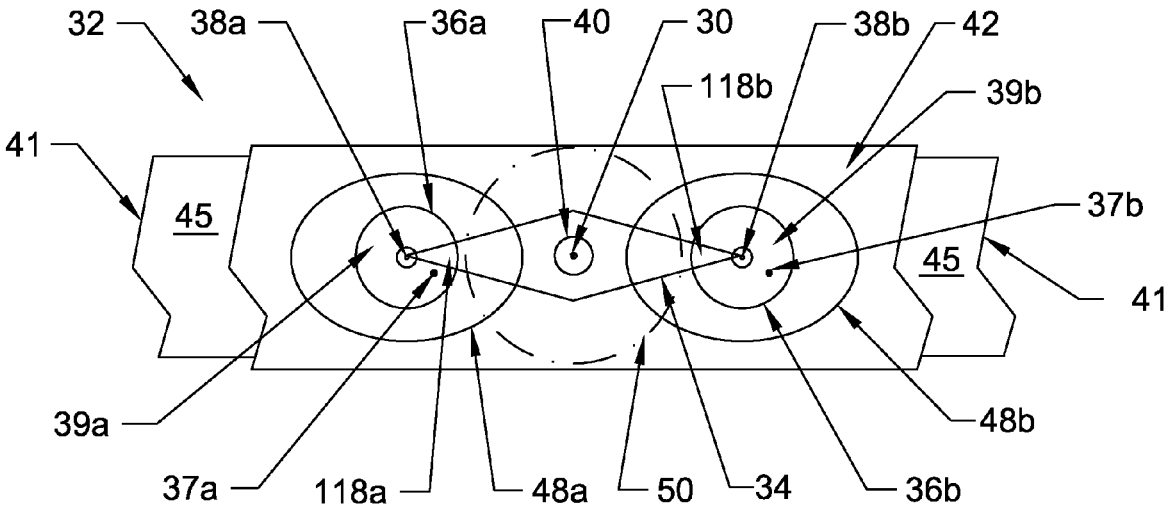
FIG. 5 is a bottom view diagram illustrating portion of an AC ionizer that uses nozzles and an orifice disposed within a placement zone in accordance with an embodiment of the present invention.

In accordance with one embodiment of the present invention, FIG. 5 illustrates the use of at least one orifice, such as orifice 30, in combination with an AC ionizer to enhance ionizer efficiency in harvesting gas ions for use in the static neutralization of a charged object (not shown). The embodiment shown includes orifice 30 disposed within a placement zone 34 that is located between adjacent nozzles 36*a* and 36*b* of AC ionizer portion 32. Nozzles 36*a* and 36*b* respectively include ionizing electrodes 38*a* and 38*b* disposed in their respective inner hollow portions 39*a* and 39*b*. Nozzles 36*a* and 36*b* utilize forced or compressed gas, which exit from jets 37*a* and 37*b*, to harvest gas ions near or at the tips of ionizing electrodes 38*a* and 38*b*.

In the embodiment in FIG. 5, orifice 30 is nominally placed midway between ionizing electrodes 38*a* and 38*b*, which enables compressed gas exiting orifice 30 to harvest gas ions trapped under the electrostatic field generated when a high voltage is applied to ionizing electrodes 38*a* and 38*b*. Further, since orifice 30 and nozzles 36*a* and 36*b* each provide an exit from which the gas may flow, an optimal allocation of the gas is obtained, resulting in a relatively low gas ion discharge time. Orifice 30 is coupled to or form on a surface 45 of a plenum 41 and located within placement zone 34. A cut-out 40 is formed on conductive surface 42, permitting a pressurized gas to flow past conductive surface 42.

Nozzles 36*a* and 36*b* are also coupled to surface 45 of plenum 41. Cut-outs 48*a* and 48*b* are formed on conductive surface 42, permitting nozzles 36*a* and 36*b* to protrude past conductive surface 42. Conductive surface 42 is used as a non-ionizing electrode and when coupled to a reference voltage, such as ground, functions as a reference electrode. Conductive surface 42 may be located on the same side of AC ionizer portion 32 on which nozzles 36*a* and 36*b* are located. In the embodiment shown in FIG. 5, conductive surface 42 is composed of a thin relatively rigid material having electrically conductive properties, such as thin metal. The use of thin metal is not intended to be limiting. For example, conductive surface 42 may be composed of a non-metallic and electrically insulating material that has a conductive coating that faces in the same general direction as the gas flow provided by nozzles 36*a* and 36*b*.

The term "cut-out" is intended to be interpreted broadly and includes any hole or aperture that is formed on a surface, such as conductive surface 42, that will permit the use of a nozzle, an orifice or both in accordance with the embodiment described with reference to FIG. 5. Those of ordinary skill in the art after receiving the benefit of this disclosure would readily recognize that using a separate plenum and conductive surfaces, such as plenum and conductive surfaces 45 and 42, respectively, is not intended to limit the present invention. For example, a conductive plating material (not shown) may be formed on surface 45 of plenum 41. This conductive plating material would have voids that are similar in diameter and location as cut-outs 40 and 48.

Gas ions found between electrodes that receive the same polarity are not tightly held to AC ionizer portion 32. Orifice 30 permits gas to exit from it, providing a high velocity flow of gas that displaces gas ions within the vicinity of orifice 30 away from AC ionizer portion 32 and towards a charged object (not shown) selected for static neutralization. This discharge flow of gas from orifice 30 creates a low pressure area and entrains additional airflow within an air entrainment zone 50. Air entrainment zone 50 covers portions of cut-outs 48*a* and 48*b* and cut-out 40, where electrostatic fields created by ionizing electrodes 38 during operation are weak.

It is contemplated that orifice 30 and jets 37*a* and 37*b* have diameters of approximately within the range of 0.010 and 0.016 inches, providing a volume of gas discharge of approximately within the range of 0.5 and 5 liters per minute, respectively, when a supply of gas at a pressure approximately between 5 and 60 psi is provided in plenum 41. These ranges are not intended to be limiting and will vary depending on the physical characteristics and design of portion 32, including the diameters selected for the nozzle and orifices, number of nozzles and orifices used, and the like.

Figure 6:
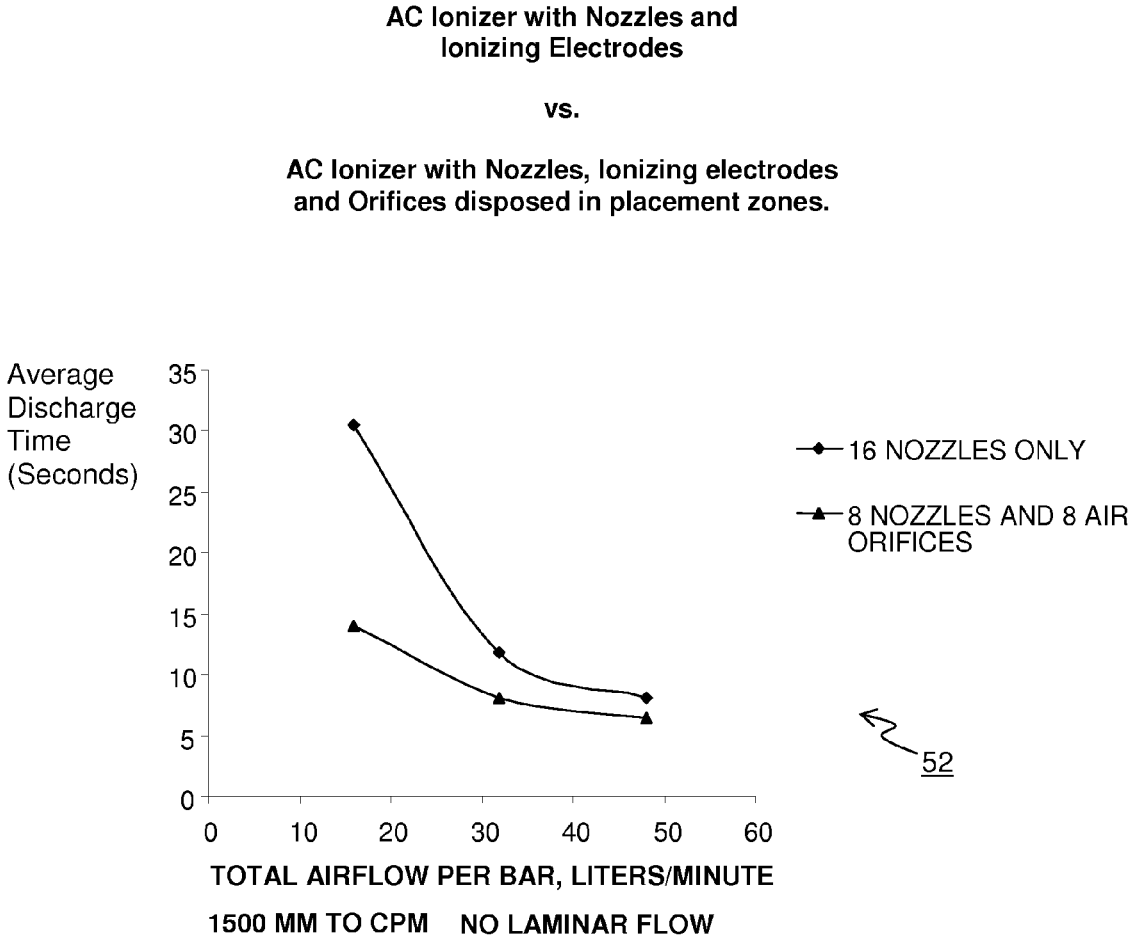
FIG. 6 is a graph showing the effect of locating orifices in a weak electrostatic field, including the effect of reducing the number of ionizing electrodes required.

As shown in FIG. 6, a graph 52 illustrates that an AC ionizer having nozzles and ionizing electrodes configured with orifices in a manner similar to that described in FIG. 5 can provide the same level of performance as an AC ionizer with roughly twice the number of nozzles and ionizing electrodes but without orifices. The values on graph 52 include measurements of time needed to reduce an electrical charge on a plate from a charge plate monitor from 1000V to 100V. These time measurements are obtained for each polarity and then averaged. Assuming all other factors constant, the ion discharge time achieved will be shorter than that of an AC ionizer that does not employ the improvement taught by the embodiment described in FIG. 5.

Figure 7:
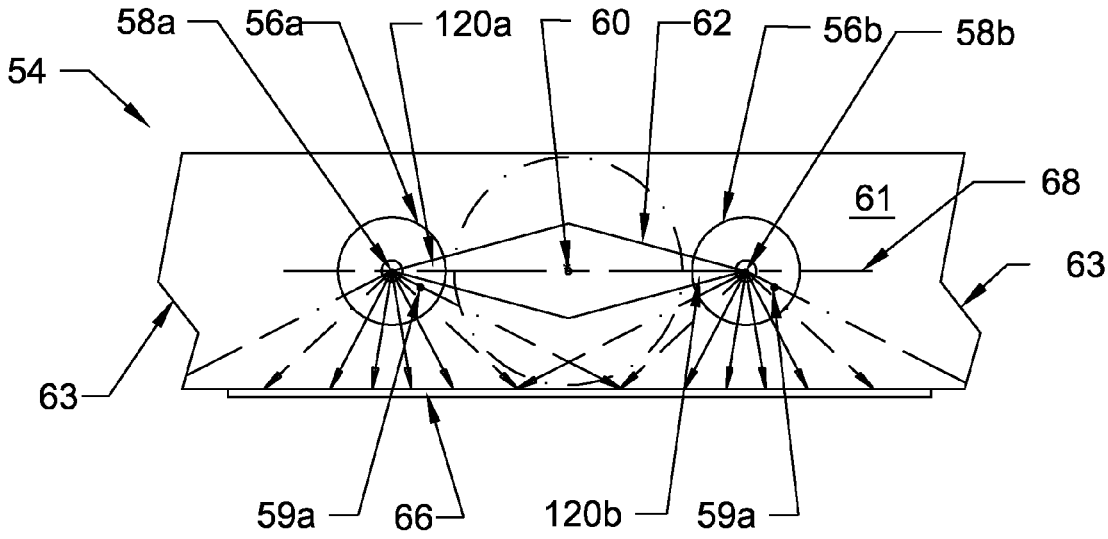
FIG. 7 is a bottom view diagram illustrating a portion of an AC ionizer that employs nozzles, an orifice in a placement zone and a single non-ionizing electrode in accordance with another embodiment of the present invention.

In accordance with another embodiment of the present invention, the embodiment disclosed in FIG. 5 may be further improved by using at least one non-ionizing electrode having the features described with reference to FIG. 7. FIG. 7 illustrates an AC ionizer portion 54 that includes at least two nozzles 56*a* and 56*b* with ionizing electrodes 58*a* and 58*b* and jets 59*a* and 59*b*, at least one orifice 60 located within a placement zone 62, and a non-ionizing electrode 66 that is used as a reference electrode. However, unlike the embodiment in FIG. 5, the example in FIG. 7 does not require cut-outs on a conductive surface since the conductive surface used as a non-ionizing electrode, such as non-ionizing electrode 66, is positioned approximately parallel to an imaginary line 68 that intersects ionizing electrodes 56*a* and 56*b* and consequently, does not impede the formation or placement of nozzles 56*a* and 56*b* and orifice 60 onto plenum surface 61. Plenum surface 61 is part of plenum 63, and plenum 63 functions as a channel or passage way through which a pressurized supply of gas may be routed to nozzles 56*a* and 56*b* and orifice 60.

Non-ionizing electrode 66 is intended to be used as a reference electrode and is thus, coupled to a reference voltage, such as ground. It is contemplated that non-ionizing electrode 66 has a shape approximately in the form of a strip. Those of ordinary skill in the art will readily recognize that the aspect ratio of the strip-like shape of non-ionizing electrode 66 is not intended to be limiting. The shape of non-ionizing electrode 66 may vary as long as non-ionizing electrode 66 does not intersect line 68. Nozzles 56*a* and 56*b*, ionizing electrodes 58*a* and 58*b*, jets 59*a* and 59*b*, orifice 60, plenum surface 61, placement zone 62, and plenum 63 may have substantially the structure and function as nozzles 36*a* and 36*b*, ionizing electrodes 38*a* and 38*b*, jets 37*a* and 37*b*, orifice 30, orifice 30, plenum surface 45, placement zone 44 and plenum 41, respectively, in FIG. 5.

Figure 8:
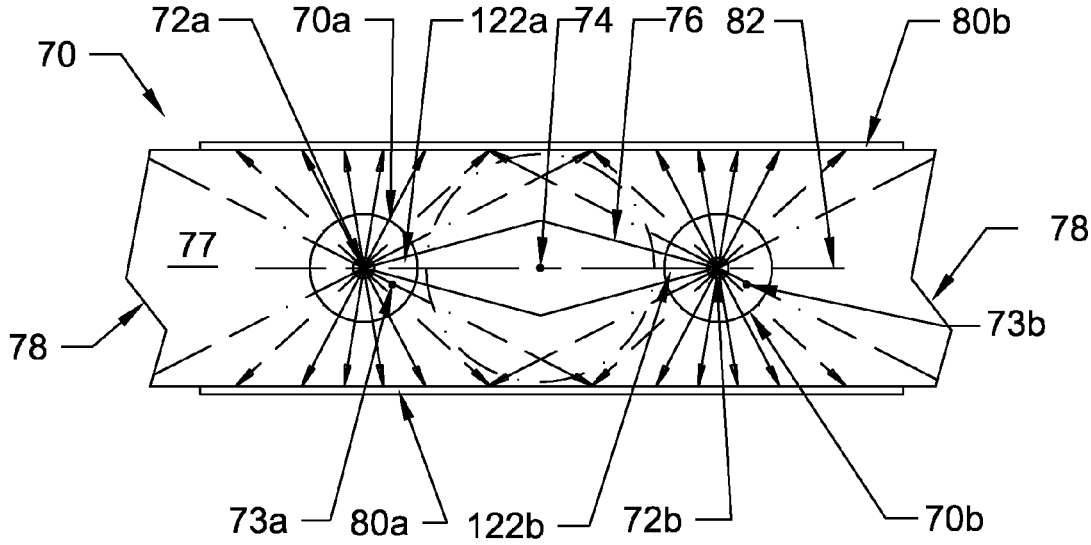
FIG. 8 is a bottom view diagram illustrating an AC ionizer that employs nozzles and orifices in a placement zone and two non-ionizing electrodes in accordance with another embodiment of the present invention.

In accordance with yet another embodiment of the present invention and as disclosed in FIG. 8, the embodiment disclosed in FIG. 7 may be further improved by using at least two non-ionizing electrodes. FIG. 8 illustrates an AC ionizer portion 70 that includes at least two nozzles 70*a* and 70*b* with ionizing electrodes 72*a* and 72*b* and jets 73*a* and 73*b*, at least one orifice 74 located within a placement zone 76, two non-ionizing electrodes 80*a* and 80*b* that are used as reference electrodes, a plenum surface 77 and a plenum 78. Nozzles 70*a* and 70*b*, ionizing electrodes 72*a* and 72*b*, jets 73*a* and 73*b*, orifice 74, placement zone 76, plenum surface 77 and plenum 78 may respectively have substantially the same function and structure as nozzles 56*a* and 56*b*, ionizing electrodes 58*a* and 58*b*, jets 59*a* and 59*b*, orifice 60, placement zone 62, plenum surface 61 and plenum 63, disclosed in FIG. 7.

Non-ionizing electrodes 80*a* and 80*b* are each similar in function and in shape to non-ionizing reference electrode 66. Non-ionizing electrodes 80*a* and 80*b* are oriented so that they do not intersect an imaginary line 82 that intersects ionizing electrodes 72*a* and 72*b*. In addition, non-ionizing electrodes 80*a* and 80*b* are disposed on opposite sides of nozzles 70*a* and 70*b*, as shown.

The embodiments disclosed in FIGS. 7 and 8 achieve even less discharge time when compared to the embodiment disclosed in FIG. 5. The embodiment in FIG. 8 takes advantage of weak field extraction of gas ions because no grounds exist between ionizing electrodes 72*a* and 72*b*, and the distances between ionizing electrodes 72*a* and 72 and an available reference potential, such as ground, provided by non-ionizing electrodes 80*a* and 80*b* are increased on average. Thus, proportionately more gas ions are bound with weak electrostatic forces using an AC ionizer modified according to the embodiment disclosed in FIG. 8. These gas ions are also be entrained by the action of the orifice(s) used, such as orifice 74. Further, the size of the non-ionizing electrodes that are used as reference electrodes, such as non-ionizing electrodes 80*a* and 80*b*, may be reduced which lowers overall capacitance and capacitance losses. One practical consequence of lower high voltage power losses is the capability to build AC ionizers with more ionizing electrodes without using larger power supplies.

Figure 9:
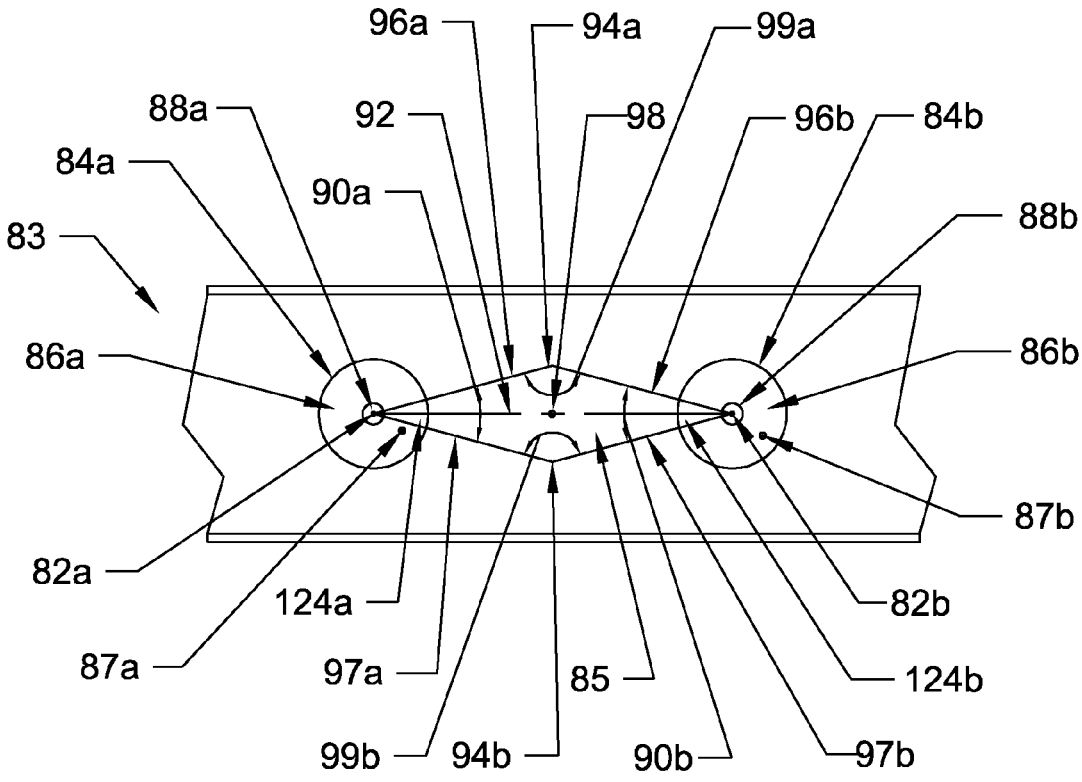
FIG. 9 shows lines and angles that define a placement zone in accordance with yet another embodiment of the present invention.

With reference to FIG. 9, the term "placement zone", such as placement zone 85, may be defined as a location on an AC ionizer portion 83 that is defined by two first opposite corners 82*a* and 82*b* situated respectively between two adjacent ionizing electrodes 88*a* and 88*b*. Nozzles 84*a* and 84*b* have inner hollow portions 86*a* and 86*b* that contain all or part of ionizing electrodes 88*a* and 88*b*, respectively. Inner hollow portions 86*a* and 86*b* also house jets 87*a* and 87*b*, respectively. Nozzles 84*a* and 84*b* and ionizing electrodes 88*a* and 88*b* may have respectively the same function and structure as nozzles 36*a* and 36*b* and ionizing electrodes 38*a* and 38*b* disclosed in FIG. 5; nozzles 56*a* and 56*b* and ionizing electrodes 58*a* and 58*b* disclosed in FIG. 7; or nozzles 70*a* and 70*b* and ionizing electrodes 72*a* and 72*b* disclosed in FIG. 8.

First opposite corners 82*a* and 82*b* respectively have first corner angles 90*a* and 90*b* that are less than or equal to 30 degrees. An imaginary straight line 92 drawn between ionizing electrodes contained within adjacent nozzles, such as ionizing electrodes 88*a* and 88*b*, bisects first corner angles 90*a* and 90*b*.

In addition, placement zone 85 may also be defined to include two second opposite corners 94*a* and 94*b* situated respectively between two adjacent ionizing electrodes, such as electrodes 88*a* and 88*b*. Second opposite corners 94*a* and 94*b* are formed by the intersection of lines 96*a* and 96*b*, and 97*a* and 97*b*, respectively. Lines 96*a* and 97*a* originate from first opposite corner 82*a*, while lines 96*b* and 97*b* originate from first opposite corner 82*b*. Second opposite corners 94*a* and 94*b* also include second corner angles 99*a* and 99*b*, respectively, which are each equal to or greater than 150 degrees. By using these descriptions with reference to FIG. 9, placement zone 85 may be said to be a geometric projection on AC ionizer portion 83 that has a "diamond-like" shape.

Figure 10:
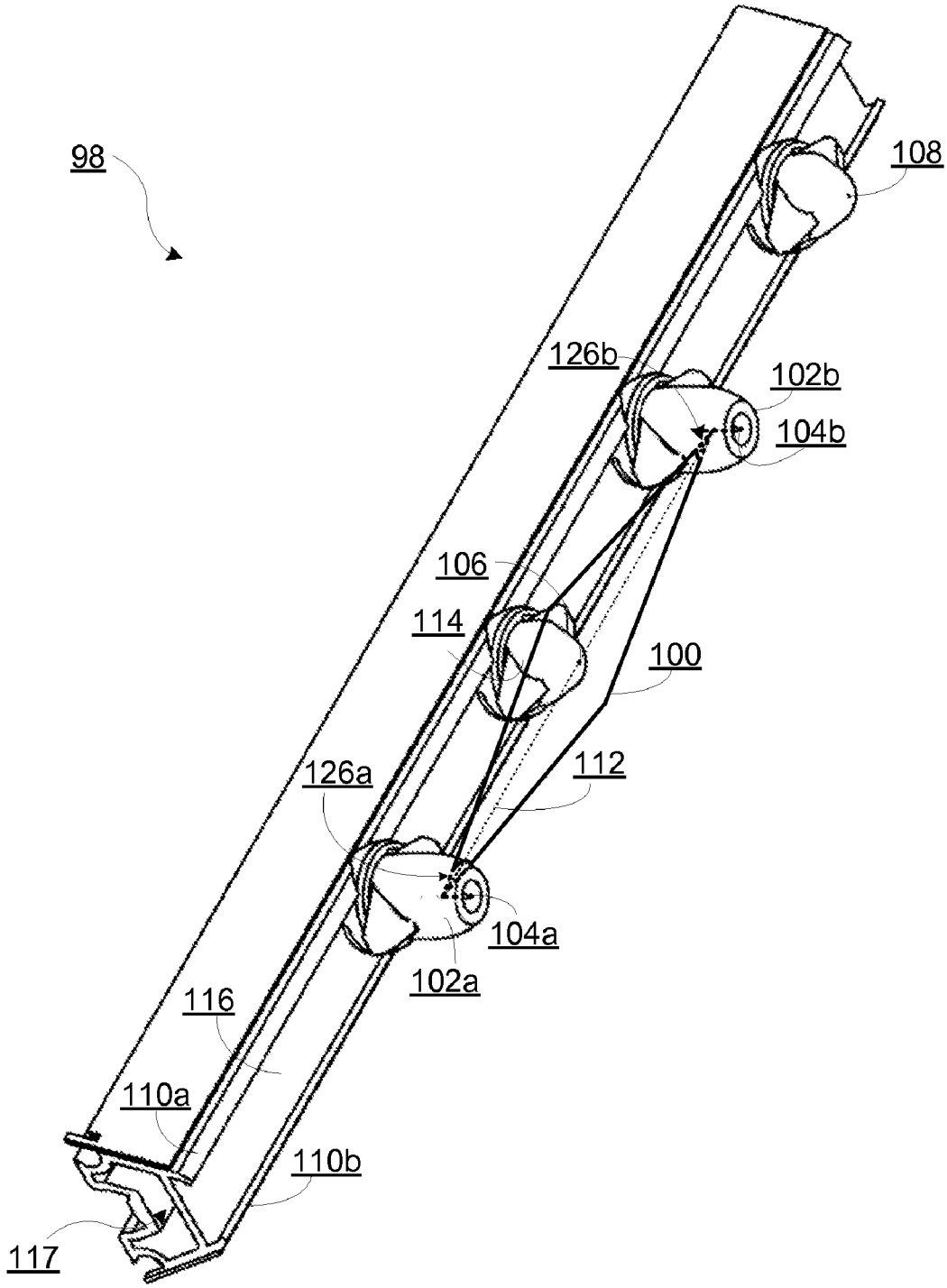
FIG. 10 is an isometric bottom view of a portion of an AC ionizer according to a further embodiment of the present invention.

Referring now to FIG. 10, a portion 98 of an AC ionizer is shown with a placement zone 100 in accordance with yet another embodiment of the present invention. Portion 98 is part of an ionizing bar, sometimes referred to as a module, that has a plurality of nozzles containing ionizing electrodes, such as nozzles 102*a* and 102*b* and ionizing electrodes 104*a* and 104*b*, and modified to have a protrusion 114 having an orifice 106 placed within placement zone 100. Other orifices may be placed within other placement zones although in FIG. 10 only orifice 108 is shown to avoid overcomplicating the figure. Portion 98 also includes two reference electrodes 110*a* and 110*b* that each have a strip-like shape and that are orientated approximately parallel to imaginary line 112. Nozzles 102*a* and 102*b*, as well as protrusion 114 are coupled to plenum surface 116. The manner of coupling nozzles 102*a* and 102*b* and protrusion 114 to plenum surface 116 is not intended to be limiting in any way. Plenum surface 116 is part of plenum 117. Nozzles 102*a* and 102*b*, ionizing electrodes 104*a* and 104*b*, orifice 106, reference electrodes 110*a* and 110*b* imaginary line 112 plenum surface 116 and plenum 117 may have approximately the same function as similarly named elements described previously above with respect to FIG. 7 or 8 above.

In accordance, with another embodiment of the present invention, the placement zones described in FIG. 5 and FIGS. 7 through 10 may be further modified by excluding sections of the placement zone that overlap areas occupied by each nozzle and ionizing electrode. Excluding these sections as part of the placement zone, avoids placing an orifice near a nozzle, and hence, an ionizing electrode. For example, these excluded sections may include areas 118*a* and 118*b*, 120*a* and 120*b*, 122*a* and 122*b*, 124*a* and 124*b* and 126*a* and 126*b* in FIGS. 5 and 7 through 10, respectively.

As disclosed in the various embodiments of the present invention, placing an orifice, such as orifice 98, within placement zone 85 of an AC ionizer having nozzles and ionizing electrodes, such as nozzles 84*a* and 84*b* and ionizing electrodes 88*a* and 88*b*, reduces gas ion discharge times, enhances gas ion harvesting or both. However, placing an orifice within placement zone 85 or using a location that has a diamond-like shape is not intended to limit the scope of various embodiments disclosed herein. One of ordinary skill in the art would readily recognize that other locations or location shapes may be used to reduce discharge times and/or enhance gas ion harvesting through any or all of the following mechanisms.

The first mechanism is breakup of the turbulence in the vicinity of an AC ionizer portion that employs nozzles. Ions trapped in turbulence are vulnerable to recombination and grounding. Orifices prevent a stable turbulent vortex from forming beneath the ionizer portion, and propel gas ions within the vortex toward a charged object targeted for static charge removal.

The second mechanism is generation of supplemental air flow due to air entrainment (air amplification) by the high velocity air, which is delivered through the orifices. This supplemental air flow helps to remove gas ions which are trapped between the nozzles.

The third mechanism is weak electrostatic field gas ion extraction. The ionizing electrodes of an AC ionizer are connected to a common electrical bus with adjacent ionizing electrodes receiving the same polarity and voltage at any given time, which creates repellant electrostatic fields between adjacent ionizing electrodes, and the weakest electrostatic field is located between adjacent ionizing electrodes or between adjacent nozzles if such ionizing electrodes are placed within the adjacent nozzles. An orifice located between adjacent ionizing electrodes is optimally positioned for removing gas ions from the AC ionizer.

Gas from an orifice within a placement zone blows perpendicular to the electric field lines in the region of weakest electrostatic field constraint, and this gas has a high probability of removing gas ions that are constrained by an electrostatic field. The removed gas ions are, hence, available to remove static charge from the charged object.

The forth mechanism is relocation of high turbulence away from the tip of an ionizing electrode where the recombination rate is potentially the highest.

The fifth mechanism is redistribution of forced or compressed gas to achieve maximum ion output. As disclosed in the various embodiments of the present invention above, nozzles utilize forced or compressed gas to harvest gas ions near or at an ionizing electrode tip, while orifices utilize compressed gas to harvest gas ions trapped under the electrostatic field generated by the ion generation process. The optimal allocation of compressed gas results in a relatively low discharge time.

While the present invention has been described in particular embodiments, it should be appreciated that the present invention should not be construed as limited by such embodiments. Rather, the present invention should be construed according to the claims below.

We claim:

1. An AC ionizer for removing static charge from a charged object, said AC ionizer including:

at least two electrodes for receiving different electrical potentials and including an ionizing electrode and a non-ionizing electrode;

at least one high voltage power supply connected to said electrodes;

a set of nozzles, including a first nozzle and a second nozzle, said first and second nozzles for providing respective gas flows;

at least one orifice for providing another gas flow;

a placement zone located between and outside of said first and second nozzles; and wherein said orifice is located within said placement zone.

2. The AC ionizer of claim 1, wherein said non-ionizing electrode is located on the same side of the ionizer as the ionizing electrodes.

3. The AC ionizer of claim 1, wherein said non-ionizing electrode has cut-outs through which said first and second nozzles are exposed.

4. The AC ionizer of claim 1, wherein said non-ionizing electrode has cut-outs through which said orifice is exposed.

5. The AC ionizer of claim 1, further including another ionizing electrode and wherein said non-ionizing electrode includes at least one conductive strip that is parallel with a row of said ionizing electrodes.

6. The AC ionizer of claim 1, wherein said ionizing electrode is electrically connected to a high voltage output of said high voltage power supply.

7. The AC ionizer of claim 1, wherein said non-ionizing electrode is connected to electrical ground.

8. The AC ionizer of claim 1, wherein said non-ionizing electrode is connected to a current controlling circuit.

9. The AC ionizer of claim 1, wherein said non-ionizing electrode is connected to a voltage controlling circuit.

10. The AC ionizer of claim 1, wherein said ionizing electrode is contained within said first nozzle.

11. The AC ionizer of claim 1, wherein said ionizing electrode is contained within said first nozzle, and further including a pressurized supply for providing a compressed gas through said first nozzle.

12. The AC ionizer of claim 11, wherein said gas also flows through said orifice.

13. The AC ionizer of claim 11, wherein said gas that flows through said first nozzle is different from a gas that flows through said orifice.

14. The AC ionizer of claim 3, wherein said first nozzle and said orifice have respective volumetric flow rates; and wherein said volumetric flow rate of said nozzle is within ±10% of said volumetric flow rate of said orifice.

15. The AC ionizer of claim 3, wherein said first nozzle and said orifice have respective volumetric flow rates; and wherein said volumetric flow rate of said first nozzle differs more than ±10% from said volumetric flow rate of said orifice.

16. The AC ionizer of claim 3, wherein said first nozzle has a cross section perpendicular to an air stream formed when gas flows through said first nozzle, said cross-section has a shape that includes any one of a polygon, a circle and an ellipse.

17. The AC ionizer of claim 14, wherein said flow of said gas inside said first nozzle is turbulent when passing said ionizing electrode.

18. The AC ionizer of claim 14, wherein said flow inside said first nozzle is laminar when passing said ionizing electrode.

19. The AC ionizer of claim 1, wherein said placement zone includes:

(a) two first opposite corners situated at two adjacent ionizing electrodes where (1) a first corner angle of each said first opposite corner is less than or equal to 30 or degrees, and (2) a straight line between said two adjacent ionizing electrodes bisects said first corner angles; and (b) two second opposite corners situated between two adjacent ionizing electrodes where (1) said second opposite corners are formed by the intersection of lines which originate from said first opposite corners, and (2) a second corner angle for each said second opposite corner is equal to or greater than 150 degrees.

20. The AC ionizer of claim 19, wherein said second opposite corners lie outside the physical dimensions of the AC ionizer.

21. The AC ionizer of claim 1, further including another ionizing electrode and wherein said placement zone has a diamond-like shape.

22. An AC ionizer for removing static charge from a charged object using corona discharge, the neutralizer comprising:

a plurality of ionizing electrodes;

nozzles respectively disposed around each of said ionizing electrodes;

a plenum connected to said nozzles;

orifices disposed within a placement zone located between said nozzles that are adjacent to each other and located on a side of the ionizer from which said ionizing electrodes are disposed said orifices for providing respective gas flows;

a conductive surface for use as a non-ionizing electrode and disposed to receive a reference potential from a high voltage power supply; and said ionizing electrodes disposed to receive a high voltage potential from said power supply.

23. The AC ionizer of claim 22, wherein said placement zone is has a diamond-like shape and is disposed between at least two of said nozzles which are adjacent to each other.

24. The AC ionizer of claim 22, wherein said placement zone includes:

two first opposite corners situated at two adjacent ionizing electrodes, wherein each said first opposite corner has a first corner angle of at least 30 degrees, and a straight line between said two adjacent ionizing electrodes bisects said first corner angles; and two second opposite corners situated between two adjacent ionizing electrodes wherein said second opposite corners are formed by the intersection of lines which originate from said first opposite corners, and a second corner angle for each said second opposite corner is at least 150 degrees.

25. The AC ionizer of claim 22, wherein said non-ionizing electrode is disposed on the same side of the static ionizer from which said ionizing electrodes are disposed.

26. The AC ionizer of claim 22, wherein said non-ionizing electrode possesses cut-outs through which said nozzles are exposed, respectively.

27. The AC ionizer of claim 22, wherein said non-ionizing electrode possesses holes through which said orifices deliver said gas flows, respectively.

28. The AC ionizer of claim 22, wherein said conductive surface has a shape of a strip.

29. The AC ionizer of claim 22, wherein said non-ionizing electrode comprises one or more conductive strips that are parallel with a row of said plurality of ionizing electrodes.

30. A method of creating an AC ionizer, comprising:

providing an alternating high voltage power source;

electrically coupling a first and a second ionizing electrode to said source;

surrounding said first and second electrodes with a first and second nozzle, respectively;

using a conductive surface as a non-ionizing electrode;

coupling a source of pressurized air or gas to said first and second nozzles; and adding at least one orifice within a placement zone located between said first and second ionizing electrodes, said at least one orifice for providing a gas flow, said placement zone not including areas occupied by said first and second nozzles and said first and second ionizing electrodes.

31. The method of claim 30, wherein said placement zone has a diamond-like shape.

32. The method of claim 30, wherein said first and second nozzles are disposed on the same side of the neutralizer from which said at least one orifice is disposed.

33. The method of claim 30, wherein said placement zone includes a first set of corners having equivalent angles, said first set including a first corner and a second corner.

34. The method of claim 33, further including disposing said first corner adjacent to said first nozzle.

35. The method of claim 34, further including disposing said second corner adjacent to said second nozzle.

36. The method of claim 30, further includes disposing said non-ionizing electrode on a side of the ionizer from which said first ionizing electrode is disposed.

37. The method of claim 30, further includes forming a plurality of cut-outs on said non-ionizing electrode through which said first nozzle is exposed and through which said at least one air orifice delivers a flow of gas.

38. An AC ionizer for removing static charge from a charged object, said ionizer including:

at least two nozzles, including a first nozzle and a second nozzle;

at least two ionizing electrodes for receiving a voltage sufficient for ionization by corona discharge, wherein respective portions of said ionizing electrodes are disposed with an inner portion of said nozzles;

a non-ionizing electrode for receiving a reference voltage;

at least one AC high voltage power supply for providing said voltage;

at least one orifice;

a placement zone located between said first and second nozzles; and wherein said orifice is located within said placement zone.

39. The AC ionizer of claim 38, further including a plenum coupled to said orifice and said nozzles.

40. The AC ionizer of claim 38, wherein said non-ionizing electrode is in the form of a conductive strip that is parallel with a row of said two ionizing electrodes.

41. The AC ionizer of claim 38, wherein said placement zone includes two first opposite corners situated at said two ionizing electrodes, wherein a first corner angle of each said first opposite corner is less than or equal to 30 or degrees, and a straight line between said two ionizing electrodes bisects said first corner angles; and said placement zone is disposed to exclude areas occupied by said first and second nozzles and said at least two ionizing electrodes.

42. The AC ionizer of claim 41, wherein said placement zone further includes two second opposite corners situated between said two ionizing electrodes, wherein said second opposite corners are formed by the intersection of lines that originate from said first opposite corners, and a second corner angle for each said second opposite corner is equal to or greater than 150 degrees.

43. The AC ionizer of claim 38, wherein said placement zone has a diamond-like shape when projected onto a surface from which said two ionizing electrodes extend.

44. An AC ionizer for removing static charge from a charged object, said AC ionizer including:

a plurality of ionizing electrodes;

a conductive surface for use as a non-ionizing electrode;

at least one high voltage power supply connected to said ionizing and non-ionizing electrodes;

a set of nozzles that includes a first nozzle and a second nozzle, said first nozzle disposed to surround at least a portion of one of said ionizing electrodes, and said first nozzle disposed to provide a gas flow past said portion;

at least one orifice for providing another gas flow, and said at least one orifice disposed within an location that is between said first and second nozzles, excluding areas occupied by said first and second nozzles and said ionizing electrode.

* * * * *